US008690508B1

(12) United States Patent
Orgeron

(10) Patent No.: US 8,690,508 B1
(45) **Date of Patent: *Apr. 8, 2014**

(54) TELESCOPING JACK FOR A GRIPPER ASSEMBLY

(75) Inventor: Keith J. Orgeron, Houston, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 57 days.

This patent is subject to a terminal disclaimer.

(21) Appl. No.: 13/114,842

(22) Filed: May 24, 2011

Related U.S. Application Data

(60) Division of application No. 12/259,251, filed on Oct. 27, 2008, now Pat. No. 7,946,795, which is a continuation-in-part of application No. 11/923,451, filed on Oct. 24, 2007, now Pat. No. 7,918,636.

(51) Int. Cl.
*E21B 19/00* (2006.01)
*E21B 19/15* (2006.01)
*E21B 19/20* (2006.01)

(52) U.S. Cl.
USPC ..... 414/22.55

(58) Field of Classification Search
USPC ..... 166/77.52, 77.53; 175/85; 254/30; 294/81.61; 414/22.55, 22.62, 23, 546, 414/680, 729, 738, 740, 742, 746.8, 783; 52/119, 120; 74/103, 110; 901/15, 21, 901/22; 91/422; 92/165 PR
See application file for complete search history.

(56) References Cited

U.S. PATENT DOCUMENTS 2,147,002 A 2/1939 Volpin
2,476,210 A 7/1949 Moore
2,535,099 A * 12/1950 Slick ..... 254/132
2,776,653 A * 1/1957 Eaton ..... 254/30
3,290,006 A * 12/1966 Dubberke ..... 254/31
3,559,821 A 2/1971 James
3,797,672 A 3/1974 Vermette
3,804,264 A 4/1974 Hedeen et al.
4,135,340 A 1/1979 Cox et al.
4,290,495 A 9/1981 Elliston
4,386,883 A 6/1983 Hogan et al.
4,403,898 A 9/1983 Thompson
4,426,182 A 1/1984 Frias et al.
4,547,110 A 10/1985 Davidson et al.
4,598,509 A 7/1986 Woolslayer et al.
4,767,100 A 8/1988 Philpot
5,865,089 A * 2/1999 Langer et al. ..... 92/110
6,854,520 B1 2/2005 Robichaux
7,036,202 B2 5/2006 Lorenz (Continued)

*Primary Examiner* — Gregory Adams

(74) *Attorney, Agent, or Firm* — John G. Fischer, Esq.; Scheef & Stone, L.L.P.

(57) ABSTRACT

A pipe handling apparatus has a base, a main rotating structural member pivotally connected to the base, a pipe handler connected to the main rotating structural member for moving a pipe from a generally horizontal orientation to a vertical orientation, and a jack connected to the pipe handler. The jack exerts a downward force in generally parallel relation to the pipe when the pipe is in the vertical orientation. The pipe handler has a gripping structure for gripping an outer surface of the pipe. The gripping structure has a stab frame. The jack is affixed to the stab frame. The jack has a piston-and-cylinder assembly positioned relative to the stab frame, and a hydraulic actuator connected to the piston-and-cylinder assembly. The hydraulic actuator is suitable for passing hydraulic fluid to the piston-and-cylinder assembly so as to move the piston-and-cylinder assembly from a retracted position to an extended position.

9 Claims, 6 Drawing Sheets

(56) References Cited

U.S. PATENT DOCUMENTS

| | | | | |
|---|---|---|---|---|
| 7,249,639 | B2 | 7/2007 | Belik | |
| 7,946,795 | B2 * | 5/2011 | Orgeron | 414/22.55 |
| 2004/0262015 | A1 * | 12/2004 | Mazzella et al. | 166/383 |
| 2005/0269133 | A1 | 12/2005 | Little | |
| 2007/0074460 | A1 | 4/2007 | Belik | |

* cited by examiner

TELESCOPING JACK FOR A GRIPPER ASSEMBLY

CROSS-REFERENCE TO RELATED APPLICATIONS

This application is a divisional application of U.S. Pat. No. 7,946,795, formerly patent application Ser. No. 12/259,251, filed Oct. 27, 2008, and issued on May 24, 2011, which is a continuation-in-part of U.S. Pat. No. 7,918,636, formerly patent application Ser. No. 11/923,451, filed Oct. 24, 2007, and issued on Apr. 5, 2011, both of which patents are hereby incorporated herein by reference, in their entirety.

BACKGROUND OF THE INVENTION

1. Field of the Invention

The present invention relates to a pipe handling apparatus. More particularly, the present invention the relates to a pipe handling apparatus for moving a pipe from a vertical orientation to a horizontal orientation. More particularly, the present invention the relates to a pipe handling apparatus that removes pipe from a well head.

2. Description of Related Art Including Information Disclosed Under 37 CFR 1.97 and 37 CFR 1.98

Drill rigs have utilized several methods for transferring tubular members from a pipe rack adjacent to the drill floor to a mousehole in the drill floor or the well bore for connection to a previously transferred tubular or tubular string. The term "tubular" or "pipe" as used herein includes all forms of drill pipe, drill collars, casing, liner, bottom hole assemblies (BHA), and other types of tubulars known in the art.

Conventionally, drill rigs have utilized a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the drill rack to the rotary table. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can damage the tubular and may affect the integrity of the connections between successive tubulars in the well.

One method of transferring pipe from the rack to the well platform comprises tying one end of a line on the rig around a selected pipe on the pipe rack. The pipe is thereafter lifted up onto the platform and the lower end thereof is placed into the mousehole. The mousehole is simply an upright, elongate cylindrical container adjacent the rotary table which supports the pipe temporally. When it is necessary to add the pipe to the drill string, slips are secured about the drill string on the rotary table thereby supporting the same in the well bore. The pipe is disconnected from the traveling equipment and the elevators, or the kelly, are connected to the pipe in the mousehole. Next, the traveling block is raised thereby positioning the pipe over the drill string and tongs are used to secure the pipe to the upper end of the drill string. The drill pipe elevators suspend the drill pipe from a collar which is formed around one end of the pipe and do not clamp the pipe thereby permitting rotational pipe movement in order to threadably engage the same to the drill string.

A prior art technique for moving joints of casing from racks adjacent to the drilling rig comprises tying a line from the rig onto one end of a selected casing joint on the rack. The line is raised by lifting the casing joint up a ramp leading to the rig platform. As the rope lifts the casing from the rack, the lower end of the casing swings across the platform in a dangerous manner. The danger increases when a floating system is used in connection with drilling. Since the rope is tied around the casing at one end thereof, the casing does not hang vertically, but rather tilts somewhat. A man working on a platform elevated above the rig floor must hold the top of the casing and straighten it out while the casing is threaded into the casing string which is suspended in the well bore by slips positioned on the rotary table.

It would be desirable to be able to grip casing or pipe positioned on a rack adjacent a drilling well, move the same into vertical orientation over the well bore, and thereafter lower the same onto the string suspended in the well bore.

In the past, various devices have been created which mechanically move a pipe from a horizontal orientation to a vertical orientation such that the vertically oriented pipe can be installed into the well bore. Typically, these devices have utilized several interconnected arms that are associated with a main rotating structural member. In order to move the pipe, a succession of individual movements of the levers, arms, and other components of the boom must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programming is required of the controller in order to properly coordinate the movements in order to achieve this desired result.

Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the pipe in a vertical orientation. Adjustments of the programming are often necessary to as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this pipe movement operation. This adds significantly to the cost associated with pipe delivery.

In the past, various patents have issued relating to such pipe handling devices. For example, U.S. Pat. No. 3,177,944, issued on Apr. 13, 1965 to R. N. Knight, describes a racking mechanism for earth boring equipment that provides for horizontal storage of pipe lengths on one side of and clear of the derrick. This is achieved by means of a transport arm which is pivoted toward the base of the derrick for swing movement in a vertical plane. The outer end of the arm works between a substantially vertical position in which it can accept a pipe length from, or deliver a pipe length to, a station in the derrick, and a substantially horizontal portion in which the arm can deliver a pipe length to, or accept a pipe length from, a station associated with storage means on one side of the derrick.

U.S. Pat. No. 3,464,507, issued on Sep. 2, 1969 to E. L. Alexander, et al., teaches a portable rotary pipe handling system. This system includes a mast pivotally mounted and movable between a reclining transport position to a desired position at the site drilling operations which may be at any angle up to vertical. The mast has guides for a traveling mechanism that includes a block movable up and down the mast through operation of cables reeved from the traveling block over crown block pulleys into a drawwork. A power drill drive is carried by the traveling block. An elevator for drill pipe is carried by arm swingably mounted relative to the power unit. Power tongs, slips, and slip bushings are supported adjacent the lower end of the mast and adapted to have a drill pipe extend therethrough from a drive bushing connected to a power drive whereby the drill pipe is extended in the direction of the hole to be drilled.

U.S. Pat. No. 3,633,771 issued on Jan. 11, 1972 to Woolslayer, et. al., discloses an apparatus for moving drill pipe into and out of an oil well derrick. A stand of pipe is gripped by a strongback which is pivotally mounted to one end of a boom. The boom swings the strongback over the rotary table thereby vertically aligning the pipe stand with the drill string. When both adding pipe to and removing pipe from the drill string, all vertical movement of the pipe is accomplished by the elevator suspended from the traveling block.

U.S. Pat. No. 3,860,122, issued on Jan. 14, 1975 to L. C. Cemosek, describes an apparatus for transferring a tubular member, such as a pipe, from a storage area to an oil well drilling platform. The positioning apparatus includes a pipe positioner mounted on a platform for moving the pipe to a release position whereby the pipe can be released to be lowered to a submerged position. A load means is operably attached or associated with the platform and positioning means in order to move the pipe in a stored position to a transfer position in which the pipe is transferred to the positioner. The positioner includes a tower having pivotally mounted thereon a pipe track with a plurality of pipe clamp assemblies which are adapted to receive a pipe length. The pipe track is pivotally movable by hydraulic power means or gear means between a transfer position in which pipe is moved into the plurality of clamp assemblies and the release position in which the pipe is released for movement to a submerged position.

U.S. Pat. No. 3,986,619, issued on Oct. 19, 1976 to Woolslayer, et. al., shows a pipe handling apparatus for an oil well drilling derrick. In this apparatus the inner end of the boom is pivotally supported on a horizontal axis in front of a well. A clamping means is pivotally connected to the outer end of the boom on an axis parallel to the horizontal axis at one end. The clamping means allows the free end of the drill pipe to swing across the boom as the outer end of the boom is raised or lowered. A line is connected at one end with the traveling block that raises and lowers the elevators and at the other end to the boom so as to pass around sheaves.

U.S. Pat. No. 4,172,684 issued on Oct. 30, 1979 to C. Jenkins, shows a floor level pipe handling apparatus which is mounted on the floor of an oil well derrick suitable structure. This apparatus includes a support that is rockable on an axis perpendicular to the centerline of a well being drilled. One end of an arm is pivotally mounted on the support on an axis transverse to the centerline of the well. The opposite end of the arm carries a pair of shoes having laterally opening pipe-receiving seats facing away from the arm. The free end of the arm can be swung toward and away from the well centerline and the arm support can be rocked to swing the arm laterally.

U.S. Pat. No. 4,403,666 issued on Sep. 13, 1983 to C. A. Willis, shows self-centering tongs and a transfer arm for a drilling apparatus. The clamps of the transfer arm are resiliently mounted to the transfer arm so as to provide limited axial movement of the clamps and thereby of a clamped down hole tubular. A pair of automatic, self-centering, hydraulic tongs are provided for making up and breaking out threaded connections of tubulars.

U.S. Pat. No. 4,407,629, issued on Oct. 4, 1983 to C. A. Willis, teaches a lifting apparatus for downhole tubulars. This lifting apparatus includes two rotatably mounted clamps which are rotatable between a side loading-position so as to facilitate the loading and unloading in the horizontal position, and a central position, in which a clamped tubular is aligned with the drilling axis when the boom is in the vertical position. An automatic hydraulic sequencing circuit is provided to automatically rotate the clamps into the side-loading position whenever the boom is pivoted with a down-hole tubular positioned in the clamp. In this position, the clamped tubular is aligned with a safety plate mounted on the boom to prevent a clamped tubular from slipping from the clamps.

U.S. Pat. No. 4,492,501 provides a platform positioning system for a drilling operation which includes a support structure and a transfer arm pivotally connected to the support structure to rotate about a first axis. This platform positioning system includes a platform which is pivotally connected to the support structure to rotate about a second axis, and rod which is mounted between the transfer arm and the platform. The position of the arm and platform axes and the length of the rod are selected such that the transfer arm automatically and progressively raises the platform to the raised position by means of the rod as the transfer arm moves to the raised position. The transfer arm automatically and progressively lowers the platform to the lowered position by means of the rod as the transfer arm moves to the lowered position.

U.S. Pat. No. 4,595,066 issued on Jun. 17, 1986 to Nelmark, et. al., provides an apparatus for handling drill pipes and used in association with blast holes. This system allows a drill pipe to be more easily connected and disconnected to a drill string in a hole being drilled at an angle. A receptacle is formed at the lower end of the carrier that has hydraulically operated doors secured by a hydraulically operated lock. A gate near the upper end is pneumatically operated in response to the hydraulic operation of the receptacle lock.

U.S. Pat. No. 4,822,230 issued on Apr. 18, 1989 to P. Slettedal, teaches a pipe handling apparatus which is adapted for automated drilling operations. Drill pipes are manipulated between substantially horizontal and vertical positions. The apparatus is used with a top mounted drilling device which is rotatable about a substantially horizontal axis. The apparatus utilizes a strongback provided with clamps to hold and manipulate pipes. The strongback is rotatably connected to the same axis as the drilling device. The strongback moves up or down with the drilling device. A brace unit is attached to the strongback to be rotatable about a second axis.

U.S. Pat. No. 4,834,604 issued on May 30, 1989 to Brittain, et. al., provides a pipe moving apparatus and method for moving casing or pipe from a horizontal position adjacent a well to a vertical position over the well bore. The machine includes a boom movable between a lowered position and a raised position by a hydraulic ram. A strongback grips the pipe and holds the same until the pipe is vertically positioned. Thereafter, a hydraulic ram on the strongback is actuated thereby lowering the pipe or casing onto the string suspended in the well bore and the additional pipe or casing joint is threaded thereto.

U.S. Pat. No. 4,708,581 issued on Nov. 24, 1987 H. L. Adair, provides a method for positioning a transfer arm for the movement of drill pipe. A drilling mast and a transfer arm is mounted at a first axis adjacent the mast to move between a lowered position near ground level and an upper position aligned with the mast. A reaction point anchor is fixed with respect to the drilling mast and spaced from the first axis. A fixed length link is pivotably mounted to the transfer arm at a second axis, spaced from the first axis, and a first single stage cylinder is pivotably mounted at one end to the distal end of the link and at the other end to the transfer arm. A second single stage hydraulic cylinder is pivotably mounted at one end to the distal end of the link and at the other end to the reaction point.

U.S. Pat. No. 4,759,414 issued on Jul. 26, 1988 to C. A. Willis, provides a drilling machine which includes a drilling superstructure skid which defines two spaced-apart parallel skid runners and a platform. The platform supports a drawworks mounted on a drawworks skid and a pipe boom is mounted on a pipe boom skid sized to fit between the skid runners of the drilling substructure skid. The drilling substructure skid supports four legs which, in turn support a drilling platform on which is mounted a lower mast section. The pipe boom skid mounts a pipe boom as well as a boom linkage, a motor, and a hydraulic pump adapted to power the pipe boom linkage. Mechanical position locks hold the upper skid in relative position over the lower skid.

U.S. Pat. No. 5,458,454 issued on Oct. 17, 1995 to R. S. Sorokan, describes a pipe handling method which is used to move tubulars used from a horizontal position on a pipe rack adjacent the well bore to a vertical position over the wall center. This method utilizes bicep and forearm assemblies and a gripper head for attachment to the tubular. The path of the tubular being moved is close to the conventional path of the tubular utilizing known cable transfer techniques so as to allow access to the drill floor through the V-door of the drill rig. U.S. Pat. No. 6,220,807 describes apparatus for carrying out the method of U.S. Pat. No. 5,458,454.

U.S. Pat. No. 6,609,573 issued on Aug. 26, 2003 to H. W. F. Day, teaches a pipe handling system for an offshore structure. The pipe handling system transfers the pipes from a horizontal pipe rack adjacent to the drill floor to a vertical orientation in a set-back area of the drill floor where the drill string is made up for lowering downhole. The cantilevered drill floor is utilized with the pipe handling system so as to save platform space.

U.S. Pat. No. 6,705,414 issued on Mar. 16, 2004 to Simpson, et. al., describes a tubular transfer system for moving pipe between a substantial horizontal position on the catwalk and a substantially vertical position at the rig floor entry. Bundles of individual tubulars are moved to a process area where a stand make-up/break-out machine makes up the tubular stands. The bucking machine aligns and stabs the connections and makes up the connection to the correct torque. The tubular stand is then transferred from the machine to a stand storage area. A trolley is moved into position over the pick-up area to retrieve the stands. The stands are clamped to the trolley and the trolley is moved from a substantially horizontal position to a substantially vertical position at the rig floor entry. A vertical pipe-racking machine transfers the stands to the traveling equipment. The traveling equipment makes up the stand connection and the stand is run into the hole.

U.S. Pat. No. 6,779,614 issued on Aug. 24, 2004 to M. S. Oser, shows another system and method for transferring pipe. A pipe shuttle is used for moving a pipe joint into a first position and then lifting upwardly toward an upper second position.

In response to the above-identified problems of the pipe handling apparatus, the present inventor filed U.S. patent application Ser. No. 11/923,451 on Oct. 24, 2007. The application discloses a pipe handling apparatus has a boom pivotally movable between a first position and a second position, a riser assembly pivotally connected to the boom, an arm pivotally connected at one end to the first portion of the riser assembly and extending outwardly therefrom, a gripper affixed to a opposite end of the arm suitable for gripping a diameter of the pipe, a link pivotally connected to the riser assembly and pivotable so as to move relative to the movement of the boom between the first and second positions, and a brace having a one end pivotally connected to the boom and an opposite end pivotally to the arm between the ends of the arm. The riser assembly has a first portion extending outwardly at an obtuse angle with respect to the second portion.

One problem associated with the pipe handling apparatus disclosed above occurs when the pipe handling apparatus removes a pipe from a well head. The pipe being removed from the wellhead can sometimes get stuck in the well head for various reasons. When this happens, the force required for removing the pipe from the well head is greater than the upward force of the pipe handling apparatus. That is, when the grippers of the pipe handling apparatus grasp the tubular that is being removed from the well head, the pipe handling apparatus does not have enough upward force so as to remove a pipe that is stuck in the well head. Thus, there is a need for a pipe handling apparatus that can overcome the force of a pipe stuck in the wellhead so as to remove the pipe from the wellhead.

Various patents have issued relating to telescoping jacks. For example, U.S. Pat. No. 5,597,987, issued on Jan. 28, 1997 to Gilliland, et. al., discloses a twin-post telescoping-jack hydraulic-elevator system. The telescoping jack has a first cylinder, an intermediate cylinder disposed within the first cylinder that is slidable relative thereto through a hydraulic seal, and an inner plunger disposed in the intermediate cylinder that is slidable relative thereto through a hydraulic seal. The intermediate cylinder has a piston which is slidably mounted in the first cylinder. The piston divides the main cylinder into a lower chamber and an upper chamber. A pair of dynamic sensors determine when the telescoping jacks are synchronized. The elevator of the system includes static sensors that determine if one or both intermediate cylinders of the jacks are more than a predetermined distance away from their normal positions when a car is stopped on the floor.

U.S. Pat. No. 5,060,762, issued on Oct. 29, 1991 to White, discloses a hydraulic elevator system. The system includes a synchronized telescoping cylinder with inner and outer reciprocating plungers mounted in a fixed cylinder. A hydraulic fluid pressure intensifier is connected to a pressure chamber of the outer plunger and to a pressure chamber of the inner plunger. Solenoid valves control a flow of hydraulic fluid between the pressure intensifier and the two plunger pressure chambers. Switches mounted on the outer plunger control operation of the solenoid valves. When the inner plunger is too low relative to the outer plunger, the pressure intensifier will raise the pressure in the inner plunger pressure chamber to appropriately lift the inner plunger. When the inner plunger is too high relative to the outer plunger, the pressure intensifier will lower the pressure in the inner plunger pressure chamber so as to lower the inner plunger.

U.S. Pat. No. 7,172,038, issued on Feb. 6, 2007 to Terry, et. al., discloses a drilling system having a work string supporting a bottom hole assembly. The work string includes lengths of pipe having a non-metallic portion. The work string preferably includes a composite-coiled tubing having a fluid impermeable liner, multiple load carrying layers, and a wear layer. Multiple electrical conductors and data transmission conductors may be embedded in the load carrying layers for carrying a current or transmitting data between the bottom hole assembly and the surface. The bottom hole assembly includes a bit, a gamma ray and inclinometer instrument package, a steerable assembly, an electronics section, a transmission, and a power section for rotating the bit. Hydraulic casing jacks are used to thrust casing into the bore hole.

U.S. Pat. No. 5,186,264, issued on Feb. 16, 1993 to Chaffaut, discloses a device for guiding a drilling tool into a well and for exerting a hydraulic force on the drilling tool. The device includes a tubular body and an outer sleeve rotating about the body and longitudinally displaceable with respect to the body. Radially displaceable pistons come into anchoring engagement with the wall of the well and immobilize the external sleeve when in an extended position. A jack displaces the body and the drilling tool integral therewith with respect to the external sleeve. The jack exerts a pushing force onto the tool. Hydraulic circuits and appropriate control assemblies are provided for controlling the execution of a series of successive cycles of anchoring the external sleeve in the well and of displacing the drilling tool with respect to the external sleeve.

U.S. Pat. No. 5,649,745, issued on Jul. 22, 1997 to Anderson, discloses an inflatable gripper assembly for a rock boring or cutting machine. The inflatable gripper assembly has a base member and an elastomeric sheet secured in a fluid-tight and reaction-force secure manner to the base member. The elastomeric sheet expands when fluid is supplied between the base member and the elastomeric sheet. The elastomeric sheet contracts when fluid is removed from between the base member and the elastomeric sheet.

U.S. Pat. No. 4,030,698, issued on Jun. 21, 1977 to Hansen, discloses a jack assembly for use in raising and lowering large platforms on columns. The jack assembly has upper and lower annular portions interconnected by a hydraulic motor for relative vertical movement there between, and arcuate pneumatically-operated gripper assemblies positioned in both the upper and lower portions of the jack. Each of the gripper assemblies is removably replaceable from its position in the jack assembly without removal of the jack assembly from the platform which it surrounds.

It is an object of the present invention to provide a pipe handling apparatus for removing a pipe that is stuck in a well head.

It is another object of the present invention to provide a pipe handling apparatus that minimizes the number of components added to such systems.

It is another object of the present invention to provide a telescoping jack that exerts an upward force on the pipe handling apparatus so as to remove a pipe from a well head.

It is another object of the present invention to provide a pipe handling apparatus that exerts an upward force on the gripper assembly thereof so as to remove a pipe from a well head.

It is still another object of the present invention to provide a pipe handling apparatus that has a telescoping jack for removing a stuck pipe from a well head.

It is an object of the present invention to provide a pipe handling apparatus which minimizes the amount of calibration required in order to move the pipe from a horizontal orientation to a vertical orientation.

It is another object of the present invention to provide a pipe handling apparatus which operates with a single degree of freedom so as to move the pipe without adjustments between the components.

It is another object of the present invention to provide a pipe handling apparatus that can be transported on a skid or on a truck.

It is another object of the present invention to provide a pipe handling apparatus which allows for the self-centering of the pipe.

It is another object of the present invention to provide a pipe handling apparatus which can be utilized independent of the existing rig.

It is still another object of the present invention to provide a pipe handling apparatus which avoids the use of multiple hydraulic cylinders and actuators for moving the pipe between a horizontal and vertical orientation.

It is another object of the present invention to provide a pipe handling apparatus which minimizes the amount of instrumentation and controls utilized for carrying out the pipe handling activities.

It is still another object of the present invention to provide a pipe handling apparatus which allows for the pipe to be loaded beneath the lifting main rotating structural member.

It is still another object of the present invention to provide a pipe handling apparatus which is of minimal cost and easy to use.

It is another object of the present invention to provide a pipe handling apparatus which allows relatively unskilled workers to carry out the pipe handling activities.

These and other objects and advantages of the present invention will become apparent from a reading of the attached specification and appended claims.

BRIEF SUMMARY OF THE INVENTION

The present invention is a pipe handling apparatus comprising a base, a main rotating structural member pivotally connected to the base, a pipe handling means connected to the main rotating structural member, and a jacking means connected to the pipe handling means. The pipe handling means moves the pipe from a generally horizontal orientation to a vertical orientation. The jacking means exerts a downward force in generally parallel relation to the pipe when the pipe is in the vertical orientation.

The pipe handling means comprises a gripping means for gripping an outer surface of the pipe. The pipe handling means also has a lever assembly pivotally connected to the main rotating structural member where the lever assembly has a first portion extending outwardly at an obtuse angle with respect to a second portion, an arm pivotally connected at one end to the first portion of the lever assembly and extending outwardly there from, a link pivotally connected to the second portion of the lever assembly where the link is pivotable at an end of the second portion opposite of the first portion so as to move relative to the movement of the main rotating structural member between the first and second positions, and a brace having a one end pivotally connected to the main rotating structural member and an opposite end pivotally connected to the arm between the ends of the arm. The pipe handling means moves the pipe between the generally horizontal orientation to the vertical orientation within a single degree of freedom.

The gripping means comprises a stab frame affixed to the opposite end of the arm, a first gripper extending outwardly of the stab frame on a side opposite the arm, and a second gripper extending outwardly of the stab frame on the side opposite the arm in spaced relation to the first gripper. The first and second grippers being translatable along the stab frame, the jacking means being connected to the stab frame of the gripping means. The jacking means is affixed to the stab frame of the gripping means.

The jacking means comprises a piston-and-cylinder assembly positioned relative to the stab frame, and a hydraulic actuator connected to the piston-and-cylinder assembly. The hydraulic actuator is suitable for passing hydraulic fluid to the piston-and-cylinder assembly so as to move the piston-and cylinder assembly from a retracted position to an extended position. The piston-and-cylinder assembly comprises a cylinder positioned relative to the stab frame, and a piston translatably positioned within an interior of the cylinder. The piston comprises a head positioned within the interior of the cylinder, and a rod extending from the head. The rod is suitable for extending outwardly of the cylinder. The cylinder has a first interior and a second interior. The head of the piston is positioned between the first interior and the second interior. The rod of the piston is positioned within the second interior. The hydraulic actuator has a first line connected to the first interior of the cylinder. The hydraulic actuator having a second line connected to the second interior of the cylinder. The hydraulic actuator suitable for passing hydraulic fluid so as to move the piston between the extended position and the retracted position.

DETAILED DESCRIPTION OF THE INVENTION

Figure 1:
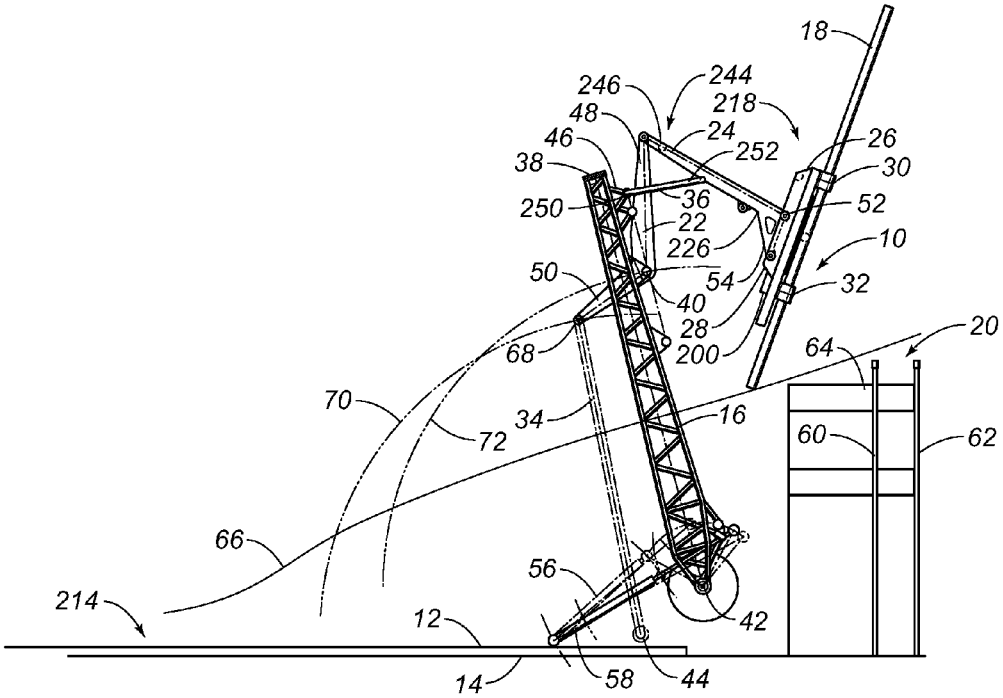
FIG. 1 is a side elevation view showing the pipe handling apparatus in accordance with the teachings of the preferred embodiment of the present invention.

Referring to FIG. 1, there is shown the pipe handling apparatus 10 in accordance with the preferred embodiment of the present invention. The pipe handling apparatus 10 is mounted on a skid 12 that is supported upon the bed 14 of a vehicle, such as a truck. The pipe handling apparatus 10 in particular includes a main rotating structural member 16 that is pivotally movable between a first position and a second position. In FIG. 1, an intermediate position of the pipe handling apparatus 10 is particularly shown. In this position, the pipe 18 is illustrated in its position prior to installation on the drill rig 20. A lever assembly 22 is pivotally connected to the main rotating structural member 16. An arm 24 is pivotally connected to an end of the lever assembly 22 opposite the main rotating structural member 16. A gripping means 26 is fixedly connected to an opposite end of the arm 24 opposite the lever assembly 22. The gripping means 26 includes a body 28 and grippers 30 and 32. A link 34 has one end pivotally connected to the skid 12 and an opposite end pivotally connected to the end of the lever assembly 22 opposite the arm 24. A brace 36 is pivotally connected to the main rotating structural member 16 and also pivotally connected to the arm 24 between the lever assembly 22 and the body 28 of gripping means 26.

In the present invention, the main rotating structural member 16 is a structural framework of struts, cross members and beams. In particular, in the present invention, the main rotating structural member 16 is configured so as to have an open interior such that the pipe 18 will be able to lifted in a manner so as to pass through the interior of the main rotating structural member 16. As such, the end 38 of the main rotating structural member 16 should be strongly reinforced so as to provide the necessary structural integrity to the main rotating structural member 16. A lug 40 extends outwardly from one side of the main rotating structural member 16. This lug 40 is suitable for pivotable connection to the lever assembly 22. The main rotating structural member 16 is pivotally connected at the opposite end 42 to a location on the skid 12. The pivotable connection at end 42 of the main rotating structural member 16 is located in offset relationship and above the pivotable connection 44 of the link 34 with the skid 12. A small frame member 46 extends outwardly from the side of the main rotating structural member 16 opposite the link 34. This frame assembly 46 has a pivotable connection with the brace 36.

The lever assembly 22 includes a first portion 48 and a second portion 50. The first portion 48 extends at an obtuse angle with respect to the second portion 50. The link 34 is pivotally connected to the end of the second portion 50 opposite the first portion 48. The arm 24 is pivotally connected to the end of the first portion 48 opposite the second portion 50. The lug 40 of the main rotating structural member 16 is pivotally connected in an area generally between the first portion 48 and the second portion 50. This unique arrangement of the lever assembly 22 facilitates the ability of the present invention to carry out the movement of the pipe 18 between the horizontal orientation and the vertical orientation.

The arm 24 has an end pivotally connected to the end of the first portion 48 of the lever assembly 22. The opposite end of the arm 24 is connected to the gripping means 26. In particular, a pair of pin connections engage a surface of the body 28 of the gripping means 26 so as to fixedly position the gripping means 26 with respect to the end of the arm 24. The pin connections 52 and 54 can be in the nature of bolts, or other fasteners, so as to strongly connect the body 28 of gripping means 26 with the arm 24. The bolts associated with pin connections 52 and 54 can be removed such that other gripping means 26 can be affixed to the end of the arm 24. As such, the pipe handling apparatus 10 of the present invention can be adaptable to various sizes of pipe 18 and various heights of drilling rigs 20.

The gripping means 26 includes the stab frame 28 with the grippers 30 and 32 translatable along the length of the stab frame 28. This vertical translation of the grippers 30 and 32 allows the pipe 18 to be properly moved upwardly and downwardly once the vertical orientation of the pipe 18 is achieved. The grippers 30 and 32 are in the nature of conventional grippers which can open and close so as to engage the outer surface of the pipe 18, as desired.

The link 34 is a elongate member that extends from the pivotable connection 44 to the pivotable connection 68 of the second portion 50 of the lever assembly 22. The link 34 is non-extensible and extends generally adjacent to the opposite side from the main rotating structural member 16 from that of the arm 24. The link 34 will generally move relative to the movement of the main rotating structural member 16. The brace 36 is pivotally connected to the small framework 46 associated with main rotating structural member 16 and also pivotally connected at a location along the arm 26 between the ends thereof. Brace 36 provides structural support to the arm 24 and also facilitates the desired movement of the arm 24 during the movement of the pipe 18 between the horizontal orientation and the vertical orientation.

Actuators 56 and 58 are illustrated as having one end connected to the skid 12 and an opposite end connected to the main rotating structural member 16 in a location above the end 42. When the actuators 56 and 58 are activated, they will pivot the main rotating structural member 16 upwardly from the horizontal orientation ultimately to a position beyond vertical so as to cause the pipe 18 to achieve is vertical orientation. Within the concept of the present invention, a single hydraulic actuator can be utilized instead of the pair of hydraulic actuators 56 and 58, as illustrated in FIG. 1.

The drilling rig 20 is illustrated as having drill pipes 60 and 62 extending upwardly so as to have an end above the drill floor 64. When the pipe 18 is in its vertical orientation, the translatable movement of the grippers 30 and 32 can be utilized so as to cause the end of the pipe 18 to engage with the box of one of the drill pipes 60 and 62.

In FIG. 1, the general movement of the bottom end of the pipe 18 is illustrated by line 66. The movement of the pivot point 68 of the connection between the lever assembly 22 and the link 34 is illustrated by line 70. Curved line 72 illustrates the movement of the pivotable connection 40 between the main rotating structural member 16 and the lever assembly 22.

In the present invention, the coordinated movement of each of the non-extensible members of the apparatus 10 is achieved with proper sizing and angular relationships. In essence, the present invention provides a four-bar link between the various components. As a result, the movement of the drill pipe 18 between a horizontal orientation and a vertical orientation can be achieved purely through the mechanics associated with the various components. As can be seen, only a single hydraulic actuator may be necessary so as to achieve this desired movement. There does not need to be coordinated movement of hydraulic actuators. The hydraulic actuators are only used for the pivoting of the main rotating structural member. Since the skid 12 is located on the bed of a vehicle 14, the vehicle 14 can be maneuvered into place so as to properly align with the centerline of the drill pipe 60 and 62 of the drilling rig 20. Once the proper alignment is achieved by the vehicle 14, the apparatus 10 can be operated so as to effectively move the drill pipe to its desired position. The gripper assemblies of the present invention allow the drill pipe 18 to be moved upwardly and downwardly for the proper stabbing of the drill pipes 60 and 62. The present invention is adaptable to various links of pipe 18.

Various types of gripping means 26 can be installed on the end of the arm 24 so as to proper accommodate longer lengths of pipe 18. These variations are illustrated herein in connections FIGS. 6-9.

As such, instead of the complex control mechanisms that are required with prior art systems, the present invention achieves it results by simple maneuvering of the vehicle 14, along with operation of the hydraulic cylinders 56 and 58. All other linkages and movement of the pipe 18 are achieved purely because of the mechanical connections between the various components. As such, the present invention assures a precise, self-centering of the pipe 18 with respect to the desired connecting pipe. This is accomplished with only a single degree of freedom in the pipe handling system.

Referring still to FIG. 1, the pipe handling apparatus 10 has a base 214, a main rotating structural member 16 pivotally connected to the base 214, a pipe handling means 218 connected to the main rotating structural member 16 for moving the pipe 18 from a generally horizontal orientation to a vertical orientation, and a jacking means 200 connected to the pipe handling means 218 for exerting a downward force in generally parallel relation to the pipe 18 when the pipe 18 is in the vertical orientation. The pipe handling means 218 has a gripping means 26 operatively connected to the frame 244 for gripping an outer surface of the pipe 18. The jacking means 200 is affixed to the stab frame frame28. The pipe handling means 218 moves the pipe 18 between the generally horizontal orientation to the vertical orientation within a single degree of freedom. The pipe handling means 218 has a lever assembly 22 pivotally connected to the main rotating structural member 16. The lever assembly 22 has a first portion 48 extending outwardly at an obtuse angle with respect to a second portion 50. An arm 24 is pivotally connected at one end 246 to the first portion 48 of the lever assembly 22 and extending outwardly therefrom. A link 34 is pivotally connected to the second portion 50 of the lever assembly 22. The link 34 is pivotable at an end of the second portion 50 opposite the first portion 48 so as to move relative to the movement of the main rotating structural member 16 between the first and second positions. A gripping means 26 is affixed to an opposite end 246 of the arm 24 for gripping an outer surface of the pipe 18. A brace 36 has one end 250 pivotally connected to the main rotating structural member 16 and an opposite end 252 pivotally connected to the arm 24 between the ends 226 and 246 of the arm 24.

Figure 2:
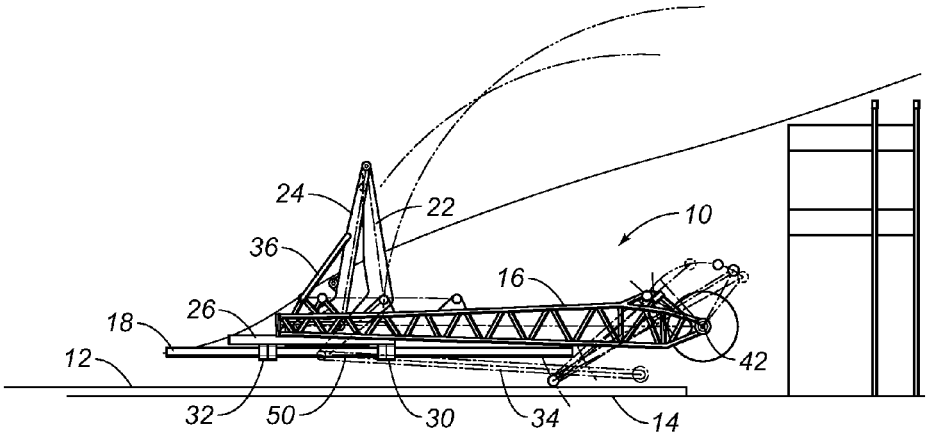
FIG. 2 is a side elevational view showing the pipe handling apparatus of the present invention in a first position.

FIG. 2 illustrates the drill pipe 18 in a generally horizontal orientation. In the present invention, it is important to note that the drill pipe can be delivered to the apparatus 10 in a position below the main rotating structural member 16. In particular, the drill pipe can be loaded upon the skid 12 in a location generally adjacent to the grippers 30 and 32 associated with the gripping means 26. As such, the present invention facilitates the easy delivery of the drill pipe to the desired location. The gripper 30 and 32 will grip the outer surface of the pipe 18 in this horizontal orientation.

In FIG. 2, it can be seen that the main rotating structural member 16 resides above the drill pipe 18 and in generally parallel relationship to the top surface of the skid 12. The lever assembly 22 is suitably pivoted so that the arm 24 extends through the interior of the framework of the main rotating structural member 16 and such that the gripping means 26 engages the pipe 18. The brace 36 resides in connection with the small framework of the main rotating structural member 16 and also is pivotally connected to the arm 24. The link 34 will reside below the main rotating structural member 16 generally adjacent to the upper surface of the skid 12 and is connected to the second portion 50 of the lever assembly 22 below the main rotating structural member 16.

Figure 3:
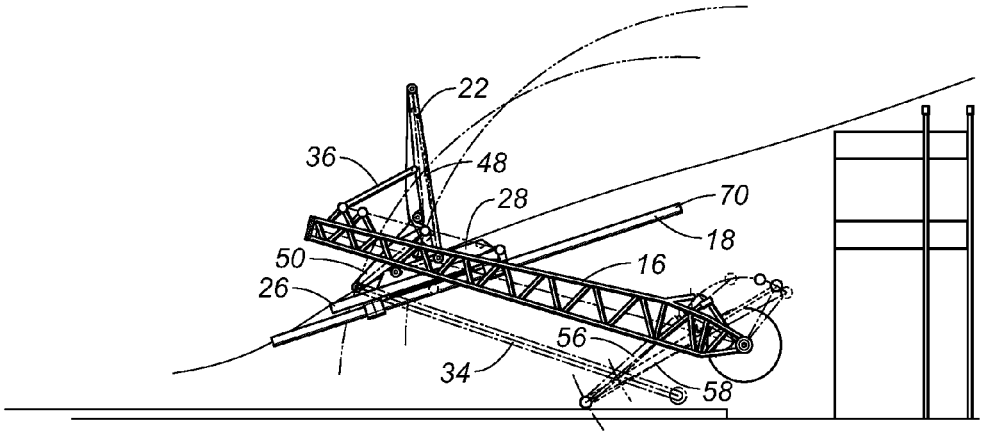
FIG. 3 is a side elevational view showing the pipe handling apparatus moving from the first position toward the second position.

FIG. 3 shows an intermediate position of the drill pipe 18 during the movement f the horizontal orientation to the vertical orientation. As can be seen, the gripping means 26 has engaged with the pipe 18. The lever assembly 22 is pivoting so that the end 70 of pipe 18 will pass through the interior of the framework of the main rotating structural member 16. Also, the arm associated with the gripping means 26 serves to move the stab frame 28 of the gripping means 26 through the interior of the framework of the main rotating structural member 16. The brace 36 is pulling on the first portion 48 of lever assembly 22 so as cause this motion to occur. The link 34 is pulling on the end of the second portion 50 of the lever assembly 22 so as to draw the first portion 48 upwardly and to cause the movement of the stab frame 28 of the gripping means 26. The hydraulic actuators 56 and 58 have been operated so as to urge the main rotating structural member 16 pivotally upwardly.

Figure 4:
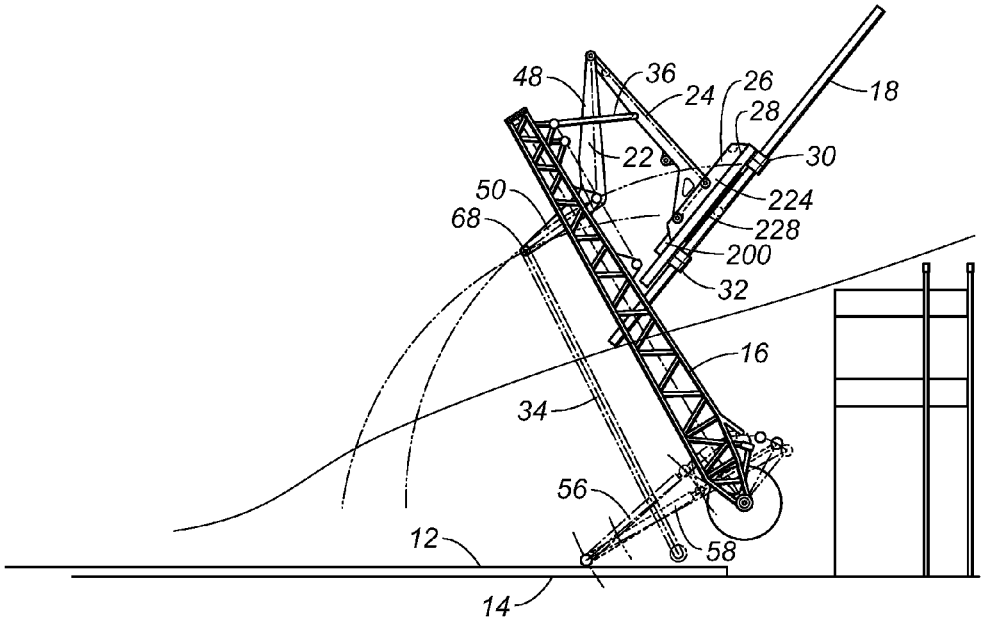
FIG. 4 is a side elevation view of the pipe handling apparatus showing the pipe handling apparatus as moving the pipe further to the second position.

FIG. 4 shows a further intermediate movement of the drill pipe 18. Once again, the hydraulic actuators 56 and 58 urge the main rotating structural member 16 angularly upwardly away from the top surface of the skid 12. This causes the link 34 to have a pulling force on the pivotal connection 68 of the second portion 50 of the lever assembly 22. This causes the first portion 48 of the lever assembly 22 to move upwardly thereby causing the arm 24, in combination with the brace 36 to lift the gripping means 26 further upwardly and draw the pipe 18 completely through the interior of the main rotating structural member 16. As can be seen, the relative size and relation of the various components of the present invention achieve the movement of the pipe 18 without the need for separate hydraulic actuators.

The gripping means 26 has a stab frame 28 having a surface 224 affixed to an opposite end 226 of the arm 24, a first gripper 30 extending outwardly of the stab frame 28 on a side 228 opposite the arm 24, a second gripper 32 extending outwardly of the stab frame 28 on the side 228 opposite the arm 24 in spaced relation to the first gripper 30. The first and second grippers 30 and 32 are translatable along the stab frame 28 of the gripping means 26.

Figure 5:
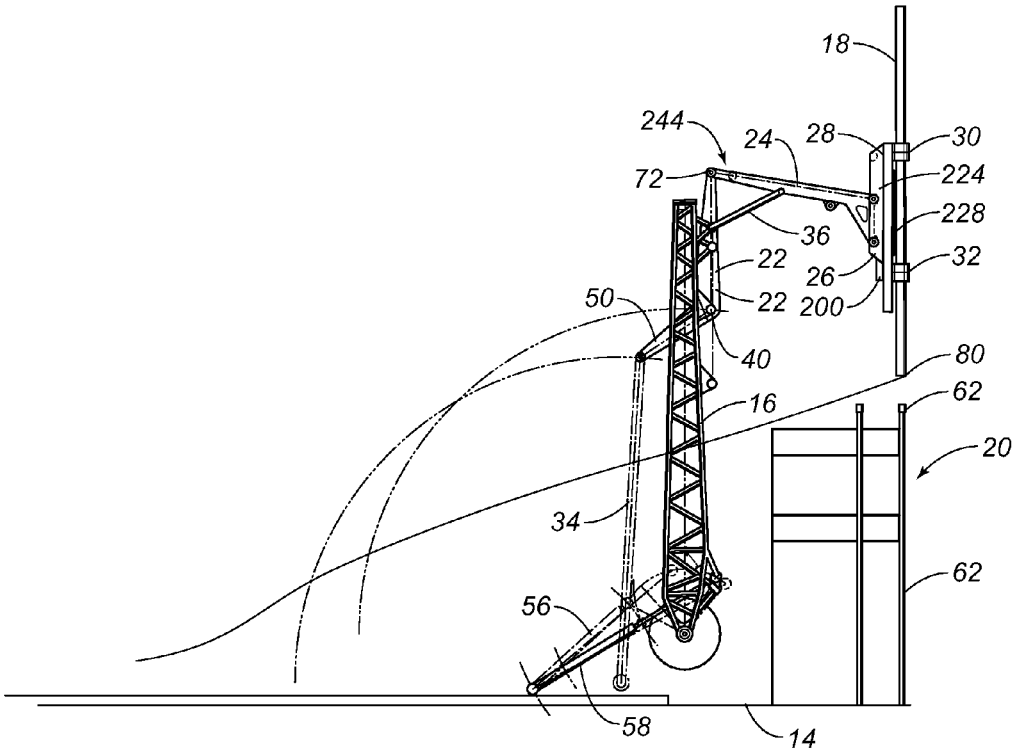
FIG. 5 is a side elevational view showing the pipe handling apparatus in its second position in which the pipe extends in a vertical orientation.

FIG. 5 illustrates the drill pipe 18 in its vertical orientation. As can be seen, the drill pipe 18 is positioned directly above the underlying pipe 62 on the drilling rig 20. The further upward pivotal movement of the main rotating structural member 16 is caused by the hydraulic cylinders 56 and 58. This causes the link 34 to rotate and draw the end of the second portion 50 of the lever assembly 22 downwardly. The lever assembly 22 rotates about the pivot point 40 such that the first portion 48 of the lever assembly 22 has a pivot 72 at its upper end. The brace 36 is now rotated in a position so as to provide support for the arm 24 in this upper position. The gripping means 26 has the gripper 30 and 32 aligned vertically and in spaced parallel relationship to each other. If any further precise movement is required between the bottom end 80 of the pipe 18 and the upper end 82 of pipe 62, then the vehicle 14 can be moved slightly so as to achieve further precise movement. In the manner described hereinbefore, the drill pipe 18 has achieved a completely vertical orientation by virtue of the interrelationship of the various components of the present invention and without the need for complex control mechanisms and hydraulics.

In order to install the drill pipe 18 upon the pipe 62, it is only necessary to vertically translate the gripper 30 and 32 within the stab frame 28 of the gripping means 26. As such, the end 80 can be stabbed into the box connection 82 of pipe 62. Suitable tongs, spinner, or other mechanisms can be utilized so as to rotate the pipe 18 in order to achieve a desired connection. The gripper 30 and 32 can then be released from the exterior of the pipe 18 and returned back to the original position such that another length of drill pipe can be installed. The jacking means 200 can be seen as affixed to the stab frame 28. The gripping means 26 is attached to the pipe handling structure 244.

Figure 6:
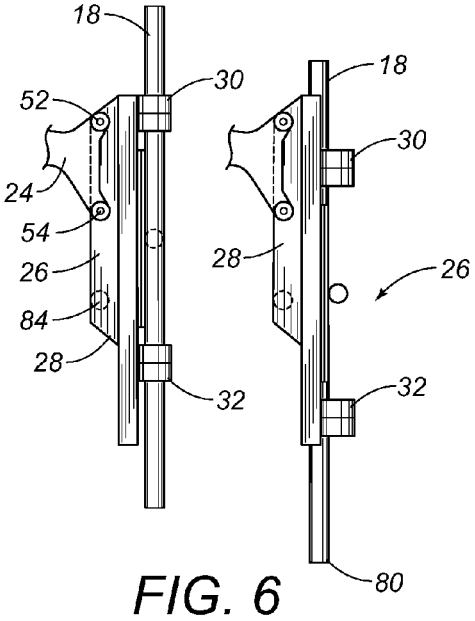
FIG. 6 is an illustration of the gripper assembly as vertically translating the pipe.

FIG. 6 is a detailed view of the gripping means 26 of the present invention. In FIG. 6 the pin connections 52 and 54 have been installed into alternative holes formed on the stab frame 28 of the gripping means 26. The holes, such as hole 84 can be formed in a surface of the stab frame 28 so as to allow selective connection between the end of the arm 24 and the stab frame 28 of gripping means 26. As such, the position of the gripping means 26 in relation to the arm 24 can be adapted to various circumstances.

It can be seen that the pipe 18 is engaged by gripper 30 and 32 of the gripping means 26. The configuration of the gripper 30 and 32, as shown in FIG. 6, is particularly designed for short length (approximately 30 feet) of drill pipe. In FIG. 6, it can be seen that the gripper 30 and 32 is translated relative to the stab frame 28 so as to lower end 80 of pipe 18 downwardly for connection to an underlying pipe.

Figure 7:
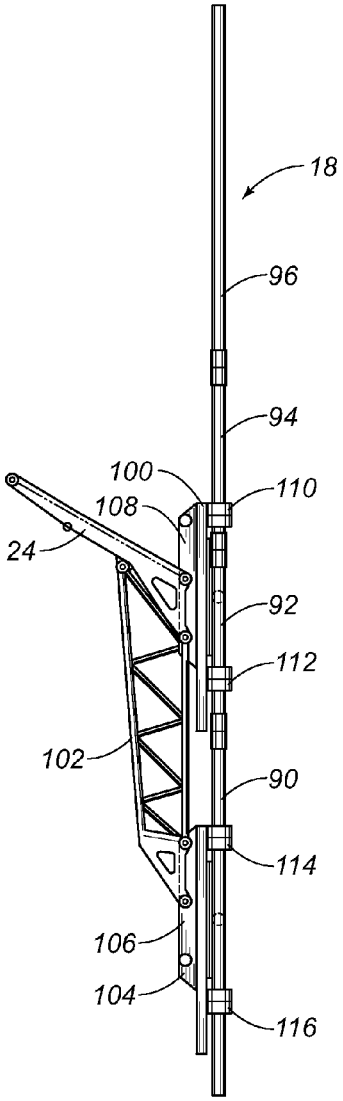
FIG. 7 is a side-elevational view of a first alternative embodiment of the gripper assembly of the present invention.

Occasionally, it is necessary to accommodate longer lengths of pipes. In other circumstances, it is desirable to accommodate pipes that are already assembled in an extended length. In FIG. 7, it can be seen that the drill pipe 18 is formed of separate sections 90, 92, 94 and 96 that are joined in end-to-end connection so as to form an extended length of the of the pipe 18. When such pipe arrangements are required, the gripping means 26 of the present invention will have to be adapted so as to accommodate such extended lengths. Fortunately, the structure of the apparatus 10 of the present invention can accommodate such an arrangement. As can be seen in FIG. 7, the arm 24 is connected to a first gripper assembly 100 and connected by stab frame 102 to a second gripper assembly 104. The second gripper assembly 104 is located directly below and vertically aligned with the first gripper assembly 100. The stab frame 102 includes a suitable pin connection for engaging the body 106 of the second gripper assembly 104. The first gripper assembly 100 has body 108 that is directly connected to the pin connections associated with the arm 24. The gripping assembly 100 includes grippers 110 and 112 which engage in intermediate position along the length of pipe 18. The grippers 114 and 116 of the second gripper assembly 104 engage the lower portion of the pipe 18. The method of moving the pipe 18 from the horizontal position to the vertical position is similar to that described hereinbefore.

It should be noted that the arm 24 can extend at various angles with respect to the gripper assembly. In the preferred embodiment, the arm 24 will be generally transverse to the length of the body associated with the gripper assemblies. However, if needed to accommodate certain drilling rig height and arrangements, the arm 24 can be angled up to 30° from transverse with respect to the body associated with the gripper assembly.

Figure 8:
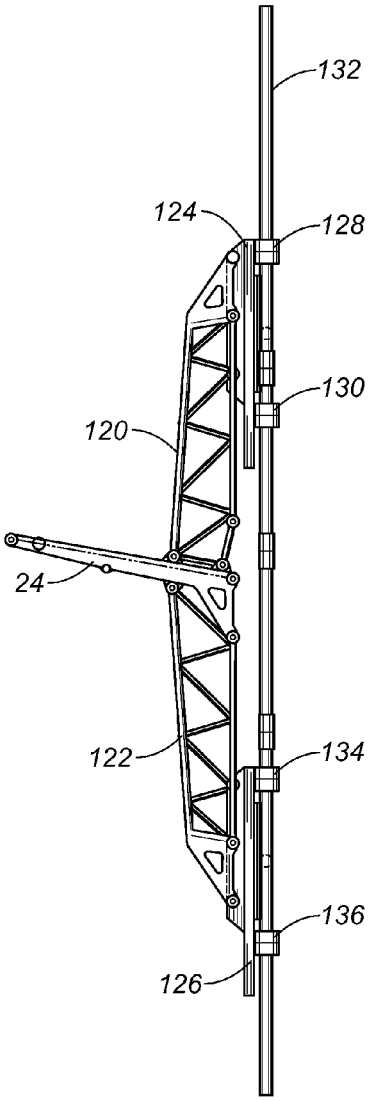
FIG. 8 is a side-elevational view showing a second alternative embodiment of the gripper assembly of the present invention.

In FIG. 8, it can be seen that the arm 24 has a first stab frame 120 extending upwardly from the top of the arm 24 and a second stab frame 122 extending below the arm 24. The stab frame 120 includes a gripper assembly 124 affixed thereto. The stab frame 122 includes a gripper assembly 126 connected thereto. The arm 24 will include suitable pin connections located on the top surface thereof and on the bottom surface thereof so as to engage with the stab frames 120 and 122. The gripper assembly 124 has suitable grippers 128 and 130 for engaging an upper portion of the pipe 132. The gripper assembly 126 includes grippers 134 and 136 for engaging with a lower portion of the pipe 132. As illustrated in FIG. 8, the pipe 132 is a multiple section pipe. However, pipe 132 can be an extended length of a single pipe section.

Figure 9:
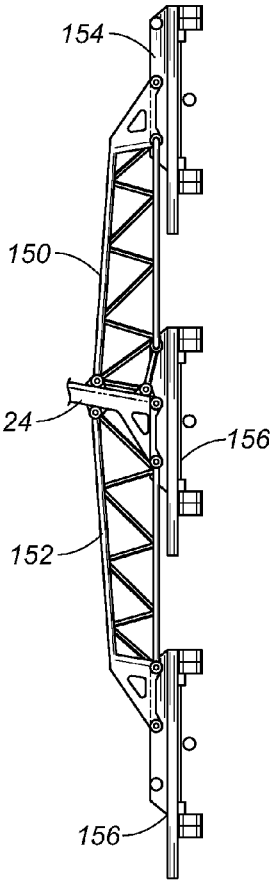
FIG. 9 is a side-elevational view showing a third alternative embodiment of the gripper assembly of the present invention.

FIG. 9 shows still another embodiment of the gripper assembly structure of the present invention. In FIG. 9, the arm 24 is connected to the upper stab frame 150 and to the lower stab frame 152. Gripping assemblies 154, 156 and 158 are provided. The gripper assembly 154 is connected to an upper end of the upper stab frame 150. The gripper assembly 158 is connected to a lower end of the lower stab frame 152. The gripper assembly 156 is intermediately located directly on the opposite side of the end of the arm 24 and connected to the lower end of the upper stab frame 150 and to the upper end of the lower stab frame 152. As such, the present invention provides up to three gripper assemblies to be connected. This can be utilized so as to accommodate even longer lengths of pipe, if needed.

The present invention achieves a number of advantages over the prior art. Most importantly, the present invention provides a pipe handling apparatus and method that minimizes the number of control mechanisms, sensors and hydraulic systems associated with the pipe handling system. Since the movement of the pipe is achieved in a purely mechanical way, only a single hydraulic actuator is necessary for the movement of the main rotating structural member. All of the other movements are achieved by the interrelationship of the various components. As such, the present invention achieves freedom from the errors and deviations that can occur through the use of multiple hydraulic systems. The simplicity of the present invention facilitates the ability of a relatively unskilled worker to operate the pipe handling system. The amount of calibration is relatively minimal. Since the skid 12 associated with the present invention can be transported by a truck, various fine movements and location of the pipe handling apparatus can be achieved through the simple movement of the vehicle. The pipe handling apparatus of the present invention is independent of the drilling rig. As such, a single pipe handling apparatus that is built in accordance with the teachings of the present invention can be utilized on a number of rigs and can be utilized at any time when required. There is no need to modify the drilling rig, in any way, to accommodate the pipe handling apparatus of the present invention. Since the pipes are loaded beneath the main rotating structural member, the providing of the pipe to the pipe handling apparatus can be achieved in a very simple manner. There is no need to lift the pipes to a particular elevation or orientation in order to initiate the pipe handling system.

In FIGS. 1-9, the jacking means 200 of the present invention is discreetly located on the stab frame 28 of the gripping means 26 of the pipe handling apparatus 10. The jacking means 200 remains in a retracted position, as shown in FIGS. 1-9, while the pipe handling apparatus 10 delivers tubulars 18 to and from the drill pipe 62. That is, the jacking means 200 is in the retracted position while the pipe handling apparatus 10 moves pipe 18 between vertical and horizontal orientations.

Figure 10:
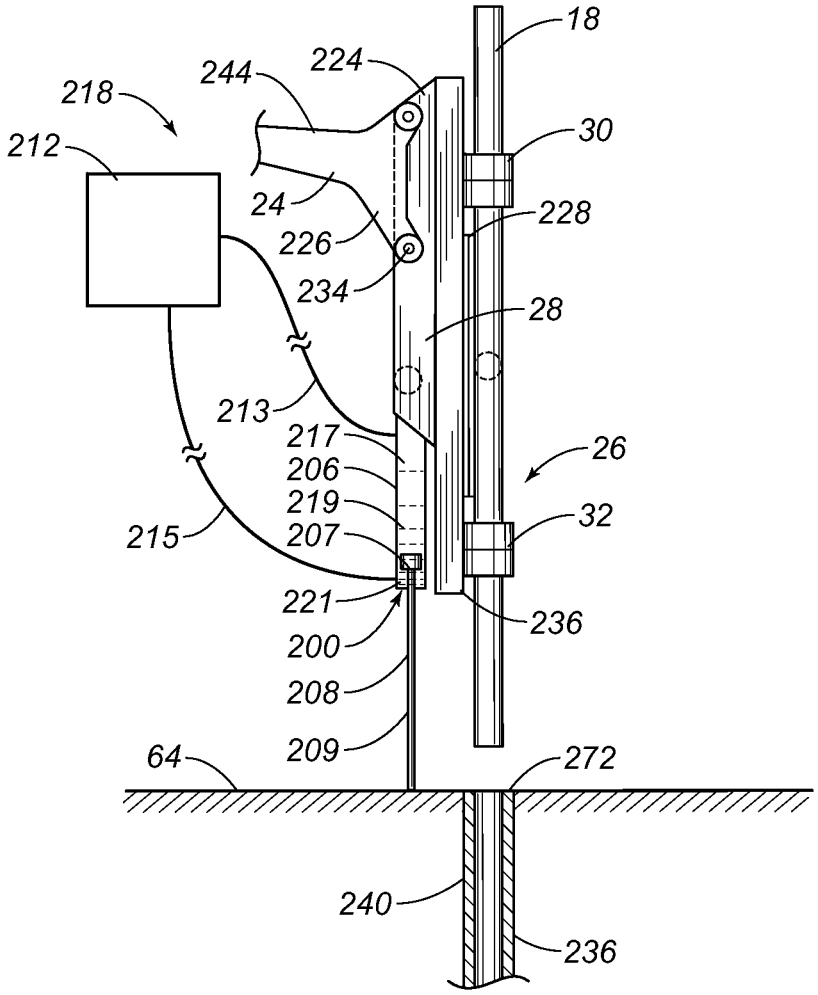
FIG. 10 shows an isolated side-elevational view of the preferred embodiment of the jacking means in the extended position.

Referring to FIG. 10, there is shown an isolated side-elevational view of the preferred embodiment of the jacking means 200 attached to the stab frame 28 of the pipe handling means 218. The jacking means 200 is affixed to the stab frame 28. The embodiment of the jacking means 200 shown in FIG. 10 is a piston-and-cylinder assembly. The piston 208 is movable within the cylinder 206. The piston 208 has a head 207 that separates the inside of the cylinder 206 into two interiors. A rod 209 is attached to the head 207 so as to form the piston 208. The head 207 and rod 209 move within the cylinder 206.

When the gripping means 26 does not have the necessary force required to remove the pipe 18 that is stuck in the well bore 238, the hydraulic actuator 212 pumps hydraulic fluid 217 through first line 213 into the first interior 219 of the cylinder 206 so as to move the piston 208 downwardly so that the rod 209 touches the well floor 64 and can push the stab frame 28 upwards, along with the pipe 18. Hydraulic fluid 217 within the second interior 221 exits the cylinder 206 through second line 215 and is recycled back to the hydraulic actuator 212. The pressure of the hydraulic fluid 217 in the first interior 219 is greater than the pressure of the hydraulic fluid 217 in the second interior 221. Hydraulic actuator 212 can be located near the pipe handling means 218 or remotely therefrom. The pipe handling means 218 can be any pipe handling apparatus. The jacking means 200 is shown in the extended position in FIG. 10. The jacking means 200 has removed the pipe 18 that was stuck in the well bore 238. The pipe 18 is positioned above the well head 242. In FIG. 10, the volume of the first interior 219 is greater than the volume of the second interior 221 when the jacking means 200 is in the extended position.

Figure 11:
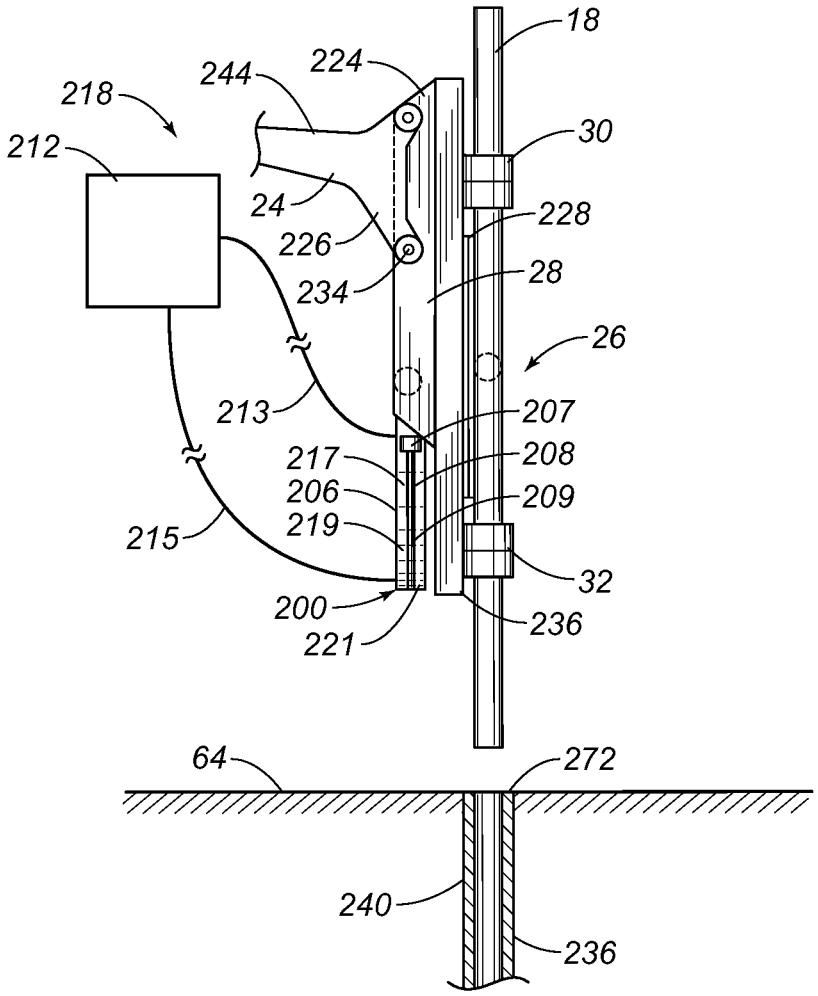
FIG. 11 shows an isolated side-elevational view of the preferred embodiment of the jacking means in the retracted position.

Referring to FIG. 11, there is shown an isolated side-elevational view of the preferred embodiment of the jacking means 200 in the retracted position. The jacking means 200 was retracted after the jacking means 200 removed the pipe 18 from the well bore 238. The piston 208 of the jacking means 200 resides within the interior of the cylinder 206. The head 207 of the piston resides near the top of the cylinder 206. Hydraulic fluid 217 was removed from the first interior 219 of the cylinder by the hydraulic actuator 212 through line 213. Hydraulic fluid 217 was pumped into the second interior 221 by the hydraulic actuator 212 through line 215. In FIG. 11, the volume of the second interior 221 is greater than the volume of the first interior 219 when the jacking means 200 is in the retracted position.

The hydraulic actuator 212 shown in FIGS. 10 and 11 can pump hydraulic fluid 217 back and forth through lines 213 and 215 so as to increase or decrease the volumes of the first and second interiors 219 and 221 so as to move the piston 208 and cylinder 206 of the jacking means 200 between the extended and retracted positions.

The method for the present invention for withdrawing a pipe from a well head includes the steps of forming a pipe handling apparatus 10 shown in FIGS. 1-9. The pipe handling apparatus 10 has a gripper 32 on an end thereof. Referring to FIGS. 10 and 11, the gripper 32 is positioned above the well head 242 so as to receive the pipe 18 therein. The gripper 32 grips the pipe 18. The stab frame 28 has a jacking means 200 positioned on a bottom 232 thereof. The jacking means 200 has piston 208 telescopically positioned adjacent the stab frame 28. The jacking means 200 is activated so as to telescopically move the piston 208 to an extended position relative to stab frame 28. Once the pipe 18 has been removed from the well bore 238, as shown in FIG. 10, the jacking means 200 is retracted so as to telescopically move the piston 208 to a retracted position relative to the base, as shown in FIG. 11. The retracted position of the jacking means 200 can be seen in FIG. 11.

While the jacking means 200 of the preferred embodiment is shown in FIGS. 10-11 has one piston 208 in a single cylinder 206, the present invention contemplates that the jacking means 200 can have any number of piston-and-cylinder assemblies in series or in parallel that are suitable for a particular application at a well head.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

The invention claimed is:

1. A pipe handling apparatus comprising:

a main rotating structural member;

a lever assembly pivotally connected to the main rotating structural member;

an arm pivotally connected to an end of the lever assembly;

a stab frame connected to an end of the arm opposite the lever assembly;

one or more grippers connected to the stab frame and operable to grip a pipe;

the grippers being translatable along the stab frame;

a telescoping jack in a retracted position remaining inside the stab frame and in an extended position extending out of the stab frame; and, the telescoping jack operable to exert a downward force on a surface generally perpendicular to the pipe gripped by the gripper.

2. The pipe handling apparatus of claim 1, wherein the grippers extend outwardly of the stab frame, and wherein the telescoping jack in the retracted position allows uninterrupted movement of the pipe handling apparatus from above the drill floor to a position away from above the drill floor.

3. The pipe handling apparatus of claim 2, the telescoping jack further comprising:

an actuator operable to move the stab frame away from the surface.

4. The pipe handling apparatus of claim 3, wherein the actuator is an hydraulic actuator.

5. The pipe handling apparatus of claim 1, further comprising:

a base to which the main rotating structural member is pivotally connected.

6. The pipe handling apparatus of claim 5, wherein the main rotating structural member and the arm are movable within a single degree of freedom so as to move the pipe from a generally horizontal orientation to a vertical orientation.

7. A pipe handling apparatus having a telescopic jack comprising:

a main rotating structural member;

a lever assembly pivotally connected to the main rotating structural member;

an arm pivotally connected to an end of the lever assembly;

a stab frame connected to an end of the arm opposite the lever assembly;

one or more grippers connected to the stab frame and operable to grip a pipe;

the grippers being translatable along the stab frame; and, wherein the telescoping jack in a retracted position remains inside the stab frame and in an extended position extends out of the stab frame.

8. The pipe handling apparatus of claim 7, wherein the telescoping jack is operable to exert downward force on a surface generally perpendicular to the pipe gripped by the gripper.

9. The pipe handling apparatus of claim 7, wherein the telescoping jack in the retracted position allows uninterrupted movement of the pipe handling apparatus from above the drill floor to a position away from above the drill floor.

* * * * *